US005709443A

United States Patent [19]

Lautenschläger

[11] Patent Number: 5,709,443

[45] Date of Patent: Jan. 20, 1998

[54] BOTTOM DRAWER SLIDE FOR DRAWERS ETC.

[75] Inventor: Horst Lautenschläger, Reinheim, Germany

[73] Assignee: MEPLA-Werke Lautenschläger GmbH and Co. KG, Germany

[21] Appl. No.: 749,395

[22] Filed: Nov. 15, 1996

[30] Foreign Application Priority Data

Jan. 31, 1996 [DE] Germany ..... 196 03 334.9

[51] Int. Cl.[6] ..... A47B 88/14

[52] U.S. Cl. ..... 312/314.14; 312/334.6; 312/334.15; 312/334.46; 312/334.47

[58] Field of Search ..... 312/334.6, 334.14, 312/334.15, 334.9, 334.27, 334.44, 334.46, 344.7, 333, 334.5, 334.47

[56] References Cited

U.S. PATENT DOCUMENTS

| | | | |
|---|---|---|---|
| 2,575,566 | 11/1951 | Shand | 312/334.15 |
| 3,836,223 | 9/1974 | Signore | 312/334.14 X |
| 5,020,869 | 6/1991 | Faust | 312/334.15 |
| 5,304,016 | 4/1994 | Lautenschlager et al. | 312/319.1 X |

FOREIGN PATENT DOCUMENTS

| | | | |
|---|---|---|---|
| 2946113 | 5/1981 | Germany . | |
| 4027468 | 3/1992 | Germany . | |
| 608384 | 9/1948 | United Kingdom | 312/334.15 |

*Primary Examiner*—Peter M. Cuomo
*Assistant Examiner*—Hanh V. Tran
*Attorney, Agent, or Firm*—Londa and Traub LLP

[57] ABSTRACT

A bottom drawer slide assembly with a guide rail is constructed as a profile rail to be secured to the carcase wall, a running rail is longitudinally movably mounted on the guide rail by means of rolling bodies retained in a cage. A hollow profile section whose cross-section is the same as the cross-section of the running rail, is pivotably connected to the inner end of the running rail. Cooperating guide means are provided on the guide rail, and the pivotable hollow profile section which hold the hollow profile section in the first position during movement of the running rail on the guide rail from the open position of the drawer in alignment with the running rail over the major portion of the inward movement, but pivot it increasingly into the second position parallel to the rear wall of the drawer when its inner end approaches the rear wall of the carcase.

7 Claims, 2 Drawing Sheets

BOTTOM DRAWER SLIDE FOR DRAWERS ETC.

The invention relates to a bottom drawer slide for drawers and the like which are retractably mounted in a cupboard and in which the guide rail, which is to be fastened to the wall and is constructed as a profiled rail, engages from below into the associated running rail, which is constituted by a hollow profile rail with an open underside and is arranged in the vicinity of the base of the drawer or of the underside of the drawer side wall, and in the interior of the running rail defines races for roller bodies, which are retained in an elongate cage and can roll on the rollways on the guide rail on the one hand and from rollways defined in associated regions of the internal surface of the running rail and thus make longitudinal movement of the running rail relative to the guide rail possible.

BACKGROUND

Due to the large number of rolling bodies spatially offset not only in the slide direction but also at right angles thereto in the shape of balls and/or rollers, drawer slides of the type in question have the advantage, in addition to easy running and a high load bearing ability that they also have a high transverse stability in the fully open state so that a drawer mounted with them in a cupboard thus has no significant play in the horizontal direction in the fully open state. Such drawer slides are thus used to an increasing extent to mount drawers in high quality articles of furniture. Also advantageous is the possibility to produce the hollow profile used for the running rail with a small height so that the running rail can be arranged—in the so-called "bottom configuration"—on the underside of the base of a drawer directly adjacent the side wall projecting downwardly above the base or—if the side walls of the drawer are constituted by hollow profiles of metal or plastics material open at the underside—within the side wall. It is thus possible to enlarge the breadth of the drawer in comparison to roller guides which must be arranged between the outer surface of the side wall of the drawer and the associated inner surface of the carcase supporting wall. The cage, which retains the rolling bodies between the slide and the running rail and fixes them at their mutual spacing from one another, requires that the travel of the drawer slide in question is limited to a distance which is shorter than the depth of the associated drawer so that the rear wall of the fully open drawer is thus still situated within the associated cupboard carcase by the dimension of the cage, i.e. the drawer slides of the type in question are so-called "partial slides." Particularly in the case of low drawers of very great depth, the rear region of the drawer which is still situated within the cupboard carcase may then be poorly seen and accessed. It would thus be desirable to produce the drawer guides as so-called "full slides" or even "over slides," in which the associated drawer can be withdrawn so far out of the cupboard carcase that its rear wall is approximately flush with or even slightly in front of the front surface of the cupboard carcase. Insofar as such full slides are offered in connection with drawer slides of the type in question, they are obtained in practice as a combination of two simple slides to form so-called "double slides." In the case of roller drawer slides, in which the height has a lesser significance because the entire height of the side wall of the drawer is available, such "double slides" are used to a large extent. On the other hand, "double slides" are usable only in special cases with the rolling body mounted drawer slides of the type in question, which are to be used in a bottom arrangement, since the vertical height is substantially increased with these slides, whereby an increase in the projecting length of the side walls of the drawer or a raising of the drawer base as regards its vertical arrangement in the side wall must be effected if the running rail arrangement is not to be visible in an undesirable manner at the underside of the drawer. The holding capacity of the drawer is, however, thereby reduced.

It has been proposed in connection with roller drawer slides in order to produce complete opening that, instead of the insertion of a further intermediate rail at the rear end of the running rail, an additional running rail portion, which is tiltable about a vertical or horizontal axis, is attached which, when the drawer is slid in and the completely closed position is approached, is so swung by an automatic control, upwardly about the horizontal axis or inwardly in front of the rear wall of the drawer about the vertical axis, that the drawer may be slid in further. When opening, on the other hand, the running rail portion, which is again in alignment with the actual running rail, makes an additional opening pathway available which makes a complete opening of the drawer possible (DE-A 2946113). In practice, such full sides have not been introduced in connection with roller drawer slides and full slides for the bottom drawer slide in question, with mounting of the running rail constructed as a hollow profile on the guide rail by means of rolling bodies, have up to now been known only in the form of the aforementioned "double slides." In a proposal by the applicant (German Patent Application 1954793 1.9), which does not form part of the state of the art, it was possible to develop the bottom drawer slides in question with rolling body mountings of the running rail on the guide rail were successfully developed into a full slide by pivotally connecting to the inner end of the running rail a hollow profile section, whose cross-section is the same as the hollow profile cross-section of the running rail, in a manner which is known per se—in connection with roller slides—so that it is pivotable out of a first position, in which it is in alignment with the running rail and directly adjacent to its end within the carcase, into a second position extending substantially parallel to the rear wall of the drawer, cooperating guide means being provided on the guide rail and in the pivotable hollow profile section over the entire path of movement which hold the hollow profile rail in alignment with the running rail during the movement of the running rail on the guide rail from the end position associated with the fully open position of the drawer over the major portion of the inward movement into the first position but swing it increasingly into the second position substantially parallel to the rear wall of the drawer when its inner end approaches the rear wall of the carcase.

It is the object of the invention further to simplify this construction in that the hollow profile section is automatically guided into the position parallel to the rear wall of the drawer only when the closed position of the drawer is approached whilst its aligned orientation with respect to the actual running rail in the further open state is effected by means of the cage mounting the rolling bodies.

SUMMARY OF THE INVENTION

This object is solved in accordance with the invention if connected to the end, closest to the rear wall of the carcase, of the profile rail constituting the guide rail so as to be pivotable about an axis extending parallel to the pivotal axis of the hollow profile section is one end of a pivotal lever, in whose free end remote from the pivotal axis an open-mouthed slit-like recess is provided, that provided on the inner end of the hollow profile section there is a projecting carrier which moves into the recess in the pivotal lever when the running rail moves in the closing direction of the drawer and the closed position is approached and if in retracted positions of the running rail, in which the carrier is situated outside the recess in the pivotal lever, the pivotal lever is held in a pivotal end position in which the open mouth of the recess is aligned with the push-in path of the carrier projecting from the hollow profile section, which is in alignment with the running rail, the recess in the pivotal lever being offset from its pivotal axis to form a lever arm such that when the carrier moves into the recess it swings the pivotal lever such that the hollow profile section pivots into the second position parallel to the rear wall of the drawer. Cooperation of the pivotal lever with the carrier provided on the hollow profile section thus occurs only in the last phase of the sliding-in process of the drawer when the carrier enters into the open mouth of the recess. The hollow profile section and the pivotal lever then cooperate in the desired manner in the manner of a toggle lever or crank linkage.

The pivotal axis of the hollow profile sections on the running rail can extend either vertically or horizontally, in each case at right angles to the direction of movement of the running rail on the guide rail, so that each hollow profile section is pivoted, when the drawer is closed, either in a horizontal plane in the direction towards the opposite side wall of the drawer or upwardly in a vertical plane in front of the rear wall of the drawer.

In order to ensure that the pivotal lever remains in the first pivotal end position when the drawer is retracted from the cupboard carcase, when the carrier has moved out of the open mouth, it is provided in an advantageous embodiment of the invention that the pivotal lever is biased by a spring into the first pivotal end position in which the open mouth of its recess is aligned with the push-in path of the carrier.

In a further advantageous embodiment of the invention a respective end of a prestressed string can engage the hollow profile section on the one hand and the running rail on the other hand so that the hollow profile section is acted on in the first pivotal position in the direction to pivot it into the first pivotal position and in a state in which it is swung out somewhat with respect thereto in the direction of the second pivotal position parallel to the rear wall of the drawer in the direction to pivot it into the second pivotal position. The arrangement of the spring is thus effected so that the hollow profile section is acted on additionally in the direction of the second pivotal position when in a state in which it is swung out only slightly with respect to the position in which it is aligned with the running rail. The result of this is that when a drawer is pushed in from the fully open position into the closed position, a force is exerted on the hollow profile section by the spring acting in the pivotal direction of the hollow profile section, before the fully closed position is reached, which force acts on the pivotal lever via the carrier and swings it out of the first pivotal end position into the second pivotal end position, whereby the hollow profile section is swung further in the direction towards a position which is substantially parallel to the rear wall of the drawer. Automatic closing of the drawer when it approaches the fully closed position is thus achieved in this manner. The arrangement of the spring on the hollow profile section can also be so effected that the biasing force of the spring acting on the hollow profile section, when in the first pivotal end position, is relatively low or approaches the value of zero, since the hollow profile section is locked by the guide rail in the position in which it is in alignment with the running rail in the retracted state of the running rail.

If the pivotal lever is biased into the first pivotal end position by a spring in the aforementioned manner, the magnitude of the biasing force of the spring engaging the hollow profile section on the one hand and the running rail on the other hand is so dimensioned that the moment produced by the spring and acting in the direction to pivot the hollow profile section in the direction of the second pivotal position is larger than the moment produced by the spring biasing the pivotal lever into the first pivotal end position.

BRIEF DESCRIPTION OF THE DRAWING

The invention will be explained in more detail in the following description of an exemplary embodiment in conjunction with the drawings, in which.

DETAILED DESCRIPTION

Figure 1:
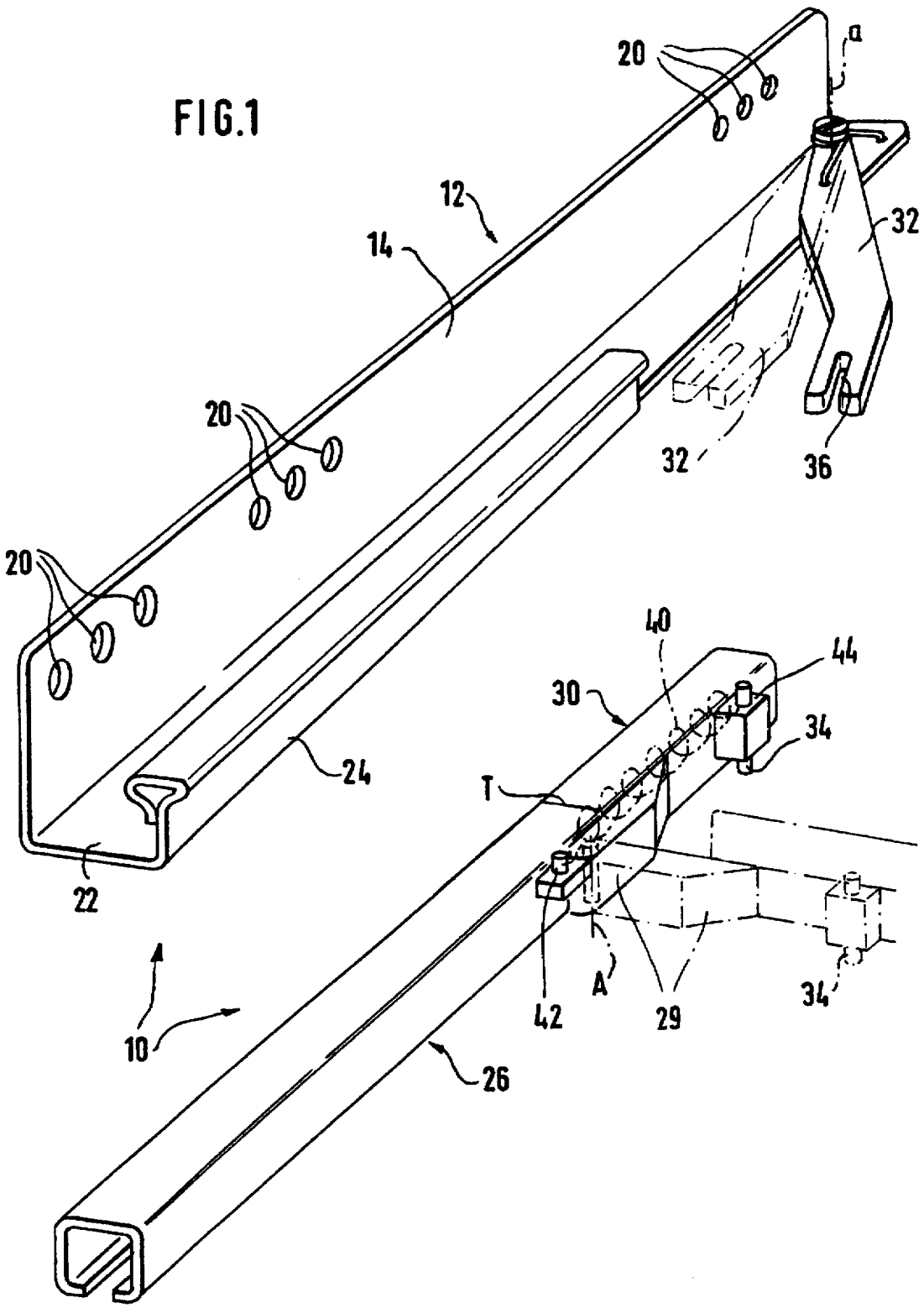
FIG. 1 is a perspective view of a bottom drawer slide constructed in the manner in accordance with the invention in which the running rail is shown removed from the guide rail.

The bottom drawer slide shown in the figures and designated as a totality with 10 has a guide rail 12 which comprises metal plate bent into a channel-shaped profile and one perpendicular profile limb 14 of which may be fastened to the inner surface of the side wall 16 of a cupboard carcase—preferably by screws 18—the threaded shafts of which are screwed through fastening bores 20 in the profile limb 14 into the side wall 16. Bent away from the lower edge of the profile limb 14 approximately at right angles is an elongate strip-shaped web section 22, from whose edge remote from the profile limb 14 a further profile limb 24 is bent upwardly at right angles. The height of this profile limb 24 measured in the vertical direction is significantly less than the height of the profile limb 14. Formed at the upper free edge of the profile limb 24 by deforming the material of the metal plate are raceways for rolling bodies, for instance for rollers—not shown—arranged with their axis horizontal and on opposite sides to the rollers, downwardly offset balls, which are also not shown and which are rotatably retained in a conventional cage at a predetermined spacing in the required position. Longitudinally movably mounted on the rolling bodies is the running rail 26, which is constructed as a hollow profile rail with an approximately inverted U-shaped cross-section and which is intended in the present case for installation on the underside of the base of a drawer (not shown) directly adjacent the associated drawer side wall projecting downwardly beyond the base of the drawer. If the side wall of the drawer is constituted by a hollow metal or plastic frame which is open at the lower end surface, the running rail can also be inserted into the open underside of this frame. Insofar as described above, the drawer slide is the same as known drawer slides of the same type.

Figure 2:
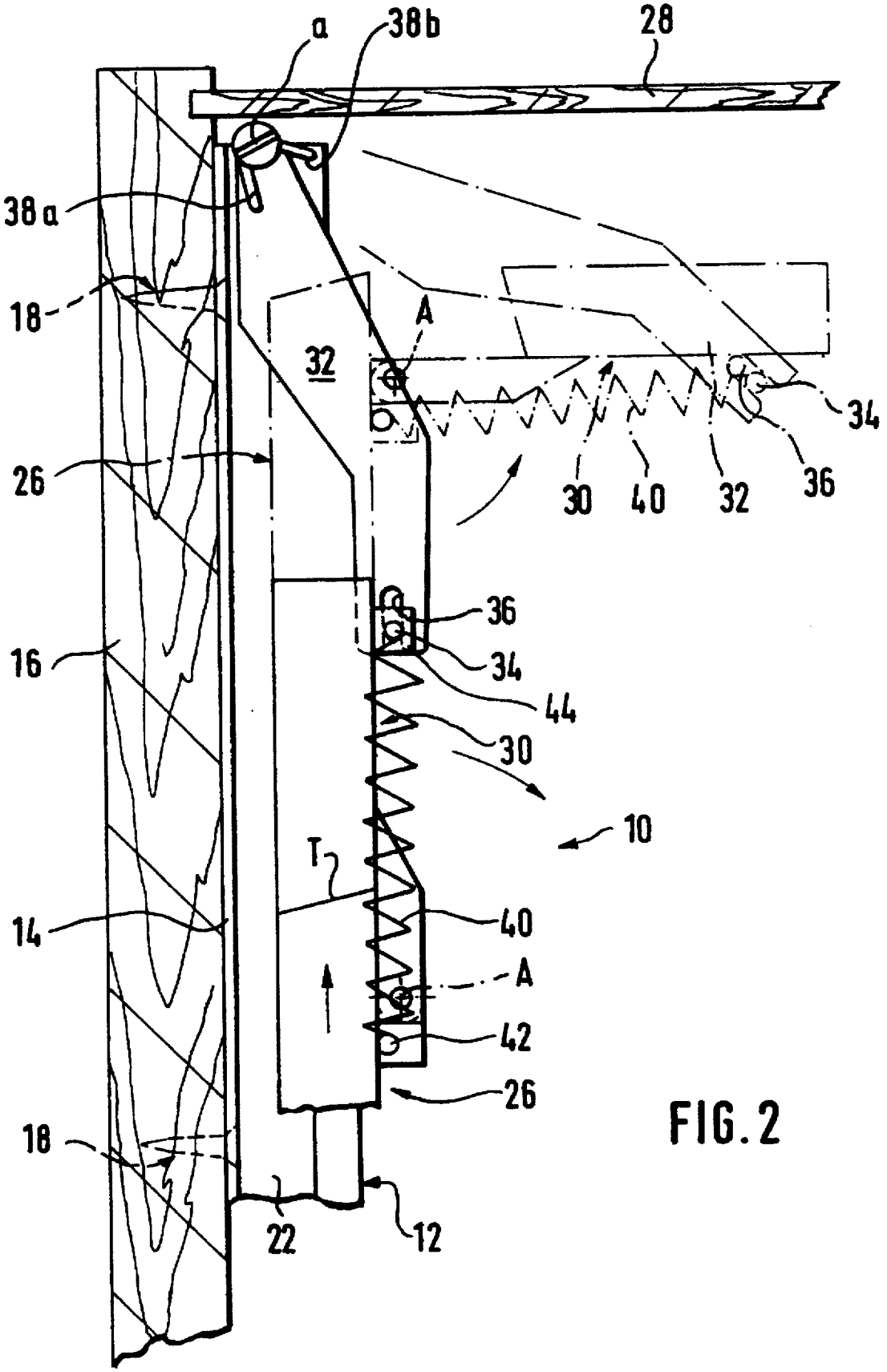
FIG. 2 is a plan view of the rear end region of the drawer slide shown in FIG. 1, the adjacent regions of the side wall and of the rear wall of an associated cupboard carcase being shown in section.

Connected to the inner end of the running rail 26 so as to pivot about an axis A extending vertically and at right angles to the direction of insertion of the drawer is a hollow profile section 30. This hollow profile section 30 has a cross-section which is the same as the hollow profile constituting the running rail 26. The pivotal connection of the hollow profile section 30 to the inner end of the running rail is effected by an intermediate lever element 29 so that this hollow profile section is pivotally movable between the two end positions shown in FIG. 2, namely a first end position—shown in solid lines—abutting and in alignment with the end of the running rail 26 and a second end position swung with respect thereto through about 90° in a horizontal plane, which is shown in FIG. 2 in chain dotted lines. Since the hollow profile section 30 is attached to the end of the running rail 26, which engages beneath the drawer over its entire length, it projects in the first end position with its complete length beyond the rear wall 28 of the drawer—not shown. The pivotal position of the hollow profile section 30 in the second position shown in chain dotted lines is so controlled in the manner described below that it is held, over the major portion of the closing or opening movement of an associated drawer, in the first end position in which the cage retaining the rolling bodies can thus also move across at least partially from the running rail 26 into the hollow profile section 30—and vice versa. Only when the drawer approaches the rear wall 28 of the associated cupboard carcase to such an extent that the free end of the hollow profile 30 is about to abut against the rear wall 28 is the hollow profile section 30 swung away from the adjacent side wall 16 into the second end position. The cage retaining the rolling bodies is then situated entirely in the running rail and thus does not impede this swinging process. In order that the hollow profile section can swing laterally horizontally away from the running rail 26, the profile limb 24 with the raceways formed at its upper end for the rolling bodies is cut away in the rear end region of the guide rail, i.e. the profile limb 24 does not extend from the front end at the exterior of the carcase completely over the entire length of the guide rail 12. Connected to the web section 22 in the inner rear end region of the guide rail in the interior of the carcase so as to pivot about a vertical axis a is a pivotal lever 32 which projects in its first pivotal end position—shown in solid lines in FIG. 2—somewhat obliquely and so far in the direction towards the open front side of the carcase that its free end is situated approximately adjacent the vertical surface of the hollow profile section 30 or of the running rail 26 directed into the interior of the carcase. Mounted at the inner end of this vertical surface of the hollow profile section 30 is a carrier 34 in the form of a peg projecting downwardly below the hollow profile section 30, associated with which in the free end of the pivotal lever 32, which is also arranged below the hollow profile section 30, is a slot-like open-mouthed recess 36. The open mouth is so aligned with respect to the carrier 34 in the first pivotal end position of the pivotal lever 32 that during the sliding in movement of a drawer and thus of the running rail 26 and of the hollow profile section 30 in the direction of the rear wall 28 of the carcase it moves into the mouth and then comes into engagement with the associated edge of the recess 36. When the running rail moves further in the sliding-in direction, the carrier 34 attempts to move the pivotal lever 32 in the direction of the rear wall 28 of the drawer. Since the pivotal lever 32 is, however, mounted on the rear end of the web section 22 to pivot about the axis a, the pivotal lever can only deflect by way of a pivotal movement—directed in the anticlockwise sense in FIG. 2. The carrier 34 is thus carried by the opposite edge of the recess 36 so as to pivot the hollow profile section 30 in the clockwise sense and the desired switching over of the hollow profile section 30, which was originally in alignment with the running rail 26, into the second end position substantially parallel to the rear wall—shown in chain dotted lines in FIG. 2—is thus effected. By means of a spring, which is shown in FIG. 2 as a leg spring 38 and whose one leg 38*a* of which is held against the pivotal lever 32 and whose other pivotal leg 38*b* is held against the web surface 22 of the guide rail 12, the pivotal lever 32 is biased into the first pivotal end position so that it automatically adopts this position when the drawer is pulled so far out of the cupboard carcase that the carrier 34 is released from the recess 36. When sliding in occurs, the pivotal lever is then swung after entry of the carrier 34 into the recess 36 against the action of the leg spring 38. The biasing force of the leg spring 38 thus increases and attempts to return the pivotal lever 32 into the first pivotal end position. If the biasing force is sufficiently high it could happen that the pivotal lever attempts to force the drawer out of the interior of the carcase via the carrier 34 and thus the hollow profile section 30, which is of course not desired. It is instead desired that the drawer is held by a suitably constructed device in the fully pushed-in end position which could be effected in the simplest case by an appropriate locking device or also by a magnetic latch.

In the illustrated exemplary embodiment, however, a possibility for holding the drawer in the closed position is illustrated which additionally automatically pulls the drawer into the fully closed position shortly before the fully closed position is reached.

This automatic closure device is constituted—in the illustrated case—by a spring constructed as a helical spring 40 prestressed in tension, one end of which is attached to a lateral mounting 42 at the inner end of the running rail 26 and the other end of which is attached to a similar mounting 44 on the hollow profile section. The arrangement of the spring by means of the mountings on the running rail 26 and the hollow profile section 30 is so effected that the longitudinal central axis of the helical spring 40 is somewhat offset towards the side wall 16 in the first pivotal position of the hollow profile section 30 with respect to the pivotal axis A. In the first pivotal position of the hollow profile section a moment is thus produced by the helical spring 40 which retains it in the first end position directed in alignment with the running rail 26.

On the other hand, when the hollow profile section 30 is swung in the clockwise direction by the pivotal lever 32 on movement into the mouth of the recess 36, the longitudinal central axis of the helical spring 40 moves into a position in which it moves over the pivotal axis A and then acts on the opposite side of the pivotal axis remote from the side wall. This has the result of reversing the direction of the moment acting on the hollow profile section 30, i.e. the hollow profile section 30 is swung so as to pivot it into the second end position parallel to the rear wall. By appropriate dimensioning of the prestressing of the helical spring 40 such that, when the hollow profile section 30 is swung out, it produces a moment together with the pivotal lever 32 which is larger than the moment with which the leg spring attempts to pivot the pivotal lever 32 into the first pivotal end position, the result may be achieved that on the one hand the pivotal lever swings in every case into the first pivotal end position when the drawer is withdrawn from the cupboard carcase and on the other hand that automatic pulling in of the drawer is achieved at the end of the sliding-in movement of the drawer when the carrier 34 is moved into the recess 36 in the pivotal lever 32 by the helical spring 40.

Particularly if the rolling bodies, which transmit the weight of the drawer in the pushed-in state via the running rail 26 onto the guide rail 12 and which are arranged between the inner surface of the web surface of the running rail and the upwardly directed raceway of the guide rail, are constructed as rollers, which are mounted in the associated cage with their axes extending horizontally at right angles to the direction of movement of the running rail, it is convenient to cause the parting plane T, which is defined, when the running rail 26 and hollow profile section 30 are in alignment with one another, between the rear edges of the running rail and the front edges of the hollow profile section, which then abut one another, to extend not at right angles to the direction of movement of the running rail but—in plan view—obliquely offset thereto so that the rolling bodies, as known to a person of ordinary skill in the art, roll through the parting plane obliquely which results in a soft, uninterrupted transfer of the rolling bodies out of the running rail 26 into the hollow profile 30—and vice versa—which does not make itself noticeable in the form of obstructions or chattering noises.

It will be apparent that modifications and developments of the exemplary embodiment described above may be realised within the scope of the inventive concept. Thus the hollow profile section 30, which makes the additional opening pathway available, can also be connected to the running rail 26 to be pivotable about a horizontal axis A extending at right angles to the opening direction of the drawer, whereby the parallel extending pivotal axis a of the pivotal lever must then also extend horizontally and vertically offset from the axis A.

What is claimed is:

1. A bottom drawer slide assembly for retractably mounting drawers such as in a cupboard carcase, comprising;

a guide rail, constructed as a profile rail, fastenable to the carcase wall, an associated running rail engaged by the guide rail from below the associated running rail, said running rail being arrangeable in the vicinity of the base of the drawer or the underside of the side wall of the drawer, and wherein said running rail is configured as a hollow profile rail, having a profile cross-section with an open underside and which defines races in the interior of the running rail for rolling bodies, said rolling bodies being retained in an elongated cage formed from a rollway surface on the guide rail and an internal surface in an associated region of the running rail, thereby allowing for longitudinal movement of the running rail relative to the guide rail, a hollow profile section, having a profile cross-section substantially similar to the hollow profile cross-section of the running rail, pivotably connected to an inner end of the running rail so as to be pivotably movable about a pivotal axis (A) from a first position in alignment with the running rail and into a second position which extends substantially parallel to a rear wall of the carcase, cooperating guide means, provided on the guide rail and the hollow profile section, for holding the hollow profile section in the first position in alignment with the running rail during movement of the running rail on the guide rail from an end position associated with a fully opened position of the drawer, and allowing the hollow profile section to increasingly pivot into the second position as the drawer's inner end approaches the rear wall of the carcase, said cooperating guide means comprising:

a pivotal lever connected by one end to the end of the guide rail so as to be pivotable about an axis (a) which extends parallel to the pivotal axis (A) of the hollow profile section, and having an open-mouthed slit-like recess provided in a free end remote from the pivotal axis (a), a projecting carrier provided on the hollow profile section, for movable association into the recess in the pivotal lever when the running rail is moved in the closing direction of the drawer towards a closed position, and wherein, in a retracted position of the running rail in which the carrier is situated outside the recess of the pivotal lever, the pivotal lever is held in a pivotal end position in which the open mouth end of recess is aligned with a push-in path of the carrier projecting from the hollow profile section, said push-in path being in alignment with the running rail, the recess in the pivotal lever being offset from its pivotal axis (a) to form a lever arm such that, when the carrier moves into the recess, the carrier swings the pivotal lever such that the hollow profile section pivots into the second position parallel to the rear wall of the carcase.

2. The bottom drawer slide assembly according to claim 1, wherein the hollow profile section is connected to the inner end of the running rail so as to be pivotable about an axis which extends vertically and at a right angle to the direction of movement of the running rail on the guide rail.

3. The bottom drawer slide assembly according to claim 1, wherein the hollow profile section is connected to the inner end of the running rail so as to be pivotable about an axis (A) extending vertically and at a right angle to the direction of movement of the running rail on the guide rail.

4. The bottom drawer slide assembly according to claim 1, wherein the pivotal lever is biased by a spring into the first pivotal end position in which the open mouth of recess is aligned with the push-in path of the carrier.

5. The bottom drawer slide assembly according to claim 4, wherein a respective end of a prestressed spring engages the hollow profile section and the running rail such that the prestressed spring acts on the hollow profile section in a direction to pivot the hollow profile section into the first pivotal position, and when the hollow profile section is swung out in the direction of the second pivotal position parallel to the rear wall of the drawer, the prestressed spring acts on the hollow profile section in a direction to pivot the hollow profile section into the second pivotal position.

6. The bottom drawer slide assembly according to claim 5, wherein the force produced by the spring acting in the direction to pivot the hollow profile section in the direction of the second pivotal position is larger than the force produced by the spring biasing the pivotal lever into the first pivotal end position.

7. The bottom drawer slide assembly according to claim 1, wherein a parting plane (T) between the running rail and the hollow profile section, when the hollow profile section is adjacent to and aligned with the inner end of the running rail, has an oblique orientation deviating from an orientation aligned at a right angle to the direction of movement of the running rail.

* * * * *